US009033696B2

(12) United States Patent
Carey et al.

(10) Patent No.: US 9,033,696 B2
(45) Date of Patent: May 19, 2015

(54) INDUCED-DRAFT LOW SWIRL BURNER FOR LOW NOX EMISSIONS

(75) Inventors: Michael R. Carey, East Hampton, CT (US); Catalin G. Fotache, West Hartford, CT (US); Scott A. Liljenberg, Wethersfield, CT (US)

(73) Assignee: Carrier Corporation, Farmington, CT (US)

( * ) Notice: Subject to any disclaimer, the term of this patent is extended or adjusted under 35 U.S.C. 154(b) by 812 days.

(21) Appl. No.: 13/281,845

(22) Filed: Oct. 26, 2011

(65) Prior Publication Data

US 2012/0148963 A1 Jun. 14, 2012

Related U.S. Application Data

(60) Provisional application No. 61/421,974, filed on Dec. 10, 2010.

(51) Int. Cl.

| | |
|---|---|
| ***F24H 3/02*** | (2006.01) |
| ***F24H 9/18*** | (2006.01) |
| ***F28D 9/00*** | (2006.01) |
| ***F28F 3/12*** | (2006.01) |
| ***F23C 3/00*** | (2006.01) |
| ***F23D 14/08*** | (2006.01) |

(52) U.S. Cl.

CPC ..... *F24H 3/025* (2013.01); *F24D 2200/046* (2013.01); *F24H 9/18* (2013.01); *F28D 9/0031* (2013.01); *F28F 3/12* (2013.01); *F23C 3/002* (2013.01); *F23D 14/08* (2013.01); *F23D 2900/14021* (2013.01)

(58) Field of Classification Search

CPC ..... F23C 7/002; F23D 14/62; F23R 3/005; F23R 3/12; F23R 3/14

USPC ..... 431/9; 126/112, 116 R

See application file for complete search history.

(56) References Cited

U.S. PATENT DOCUMENTS

| | | | | |
|---|---|---|---|---|
| 4,515,145 | A * | 5/1985 | Tallman et al. | 126/99 A |
| 4,945,890 | A | 8/1990 | Ripka | |
| 5,197,871 | A * | 3/1993 | Yamamoto et al. | 431/262 |
| 5,341,795 | A * | 8/1994 | Chou et al. | 126/110 R |
| 5,735,681 | A | 4/1998 | Cheng | |
| 5,879,148 | A | 3/1999 | Cheng et al. | |

* cited by examiner

*Primary Examiner* — Avinash Savani

(74) *Attorney, Agent, or Firm* — Miller, Matthias & Hull LLP

(57) ABSTRACT

A burner for use with an induced draft furnace and which satisfies reduced nitrous oxide ($NO_x$) emission standards is disclosed. The burner may employ a mechanical swirler that introduces a rotational vector to the emitted air and fuel mixed by the burner. By introducing the rotational vector, the resulting flame is more stable and sustainable even with the relatively low air flow afforded by an induced system. Such flame stability can be enhanced by positioning the burner directly within an inlet to a heat exchanger and manufacturing the inlet with reception surfaces that form a frusto-conically shaped flame expansion zone. In doing so, a secondary source of air is avoided and $NO_x$ emissions are reduced.

20 Claims, 3 Drawing Sheets

INDUCED-DRAFT LOW SWIRL BURNER FOR LOW NOX EMISSIONS

CROSS-REFERENCE TO RELATED APPLICATION

This is a non-provisional US patent application, which claims priority under 35 USC §119(e) to U.S. Provisional Patent Application Ser. No. 61/421,974 filed on Dec. 10, 2010.

TECHNICAL FIELD OF THE DISCLOSURE

The present disclosure generally relates to gas burners and furnaces and, more particularly, relates to gas burners and furnaces which employ an induced draft.

BACKGROUND OF THE DISCLOSURE

Induced draft gas furnaces are commonly used to generate heat for residential and commercial use. Such furnaces vary in design, but at their core serve the basic function of igniting gas (typically natural gas or propane) and air, and directing the resulting combustion gases to a heat exchanger. The combustion gases are of an elevated temperature and by directing same through serpentine conduits provided as part of the heat exchanger, air to be heated can then be directed across the heat exchanger to extract heat from the heat exchanger. A blower motor provided as part of the furnace can be used to create the air flow across the outside surface of the heat exchanger. The heated air then exits the furnace and by way of ductwork is communicated to the rooms or space needing to be heated.

The heat exchangers of such furnaces typically employ a plurality of heat exchanger coils, each one having a burner associated with an inlet to the coil. The burner serves the function of mixing the gas and air and igniting same to generate a flame. The burner outlet with such prior art designs is positioned close to, but spaced from, the heat exchanger coil so as to direct at least a portion of the flame into the heat exchanger coil. The gas is typically introduced into the burner by way of a gas supply controlled by a processor of the furnace. The air needed for combustion is typically provided by way of another blower motor which pulls (induced draft) air through the burner and pulls the flame and combustion gases through the heat exchanger.

While effective and commercially successful, air quality regulations are becoming increasing stringent. For example, federal, state and local authorities regulate acceptable emissions standards of nitrous oxide ($NO_x$), among others. The SCAQMD (South Coast Air Quality Management District) of California is one example of a regulatory body dictating a maximum emission rate of $NO_x$. Given the current climate and popular opinion regarding the environment, these standards are likely to only get more restrictive in the future.

As a result of such regulations, prior art burners have had to be redesigned. Certain prior art burners, known as "in-shot" burners, included two sources of air: a primary source providing air to the inlet of the burner for mixing with the gas, and a secondary source at the outlet of the burner and prior to introduction of the flame to the heat exchanger. However, in order to reduce $NO_x$ emissions, that secondary source of air has to be eliminated. While reduction in $NO_x$ emissions have been achieved in forced drafted system (blower at inlet) burners for use with induced draft furnaces which satisfy the emissions standards have not been introduced.

SUMMARY OF THE DISCLOSURE

In accordance with one aspect of the disclosure, a furnace is disclosed which comprises a heat exchanger having an inlet and an outlet, the outlet being connected to a vent, an inducer motor operatively associated with the heat exchanger outlet to draw air through the heat exchanger, a burner tube adapted to direct a flame into the heat exchanger inlet, the burner tube having an inlet and an outlet, a swirler provided with the burner tube between the inlet and the outlet, a source of fuel connected to the burner tube inlet, a source of air operatively associated with the burner tube inlet, and a blower motor adapted to direct air flow across the heat exchanger to extract heat from the heat exchanger.

In accordance with another aspect of the disclosure, a heat exchanger assembly is disclosed which comprises a heat exchanger coil having an inlet and outlet, the inlet including reception surfaces forming a frusto-conically shaped flame expansion zone, an inducer motor operatively associated with the heat exchanger coil outlet, and a burner tube positioned within the heat exchanger coil inlet, the burner tube including an inlet and an outlet with a swirler between the inlet and outlet.

In accordance with yet another aspect of the disclosure, a method of operating an induced draft furnace is disclosed which comprises providing a heat exchanger having an inlet and an outlet, connecting a motorized fan to the heat exchanger outlet and thereby inducing an air flow through the heat exchanger, positioning a burner in the heat exchanger inlet, the burner including an inlet, an outlet, and a swirler between the inlet and the outlet, pre-mixing air and fuel in the inlet of the burner, inducing flow of the mixed air and fuel through the burner with the motorized fan, introducing a swirling flow pattern to the mixed air and fuel by passing the mixed air and fuel through the swirler, igniting the mixed air and fuel into a flame, and directing the flame into the heat exchanger inlet.

These and other aspects and features of the disclosure will be explained in further detail herein in conjunction with the accompanying drawings.

While the following detailed description will be given with respect to certain illustrative embodiments, it is to be understood that the teachings of the present disclosure can be used in conjunction with other embodiments not specifically disclosed but encompassed by the spirit and scope of the appended claims.

DETAILED DESCRIPTION

Figure 1:
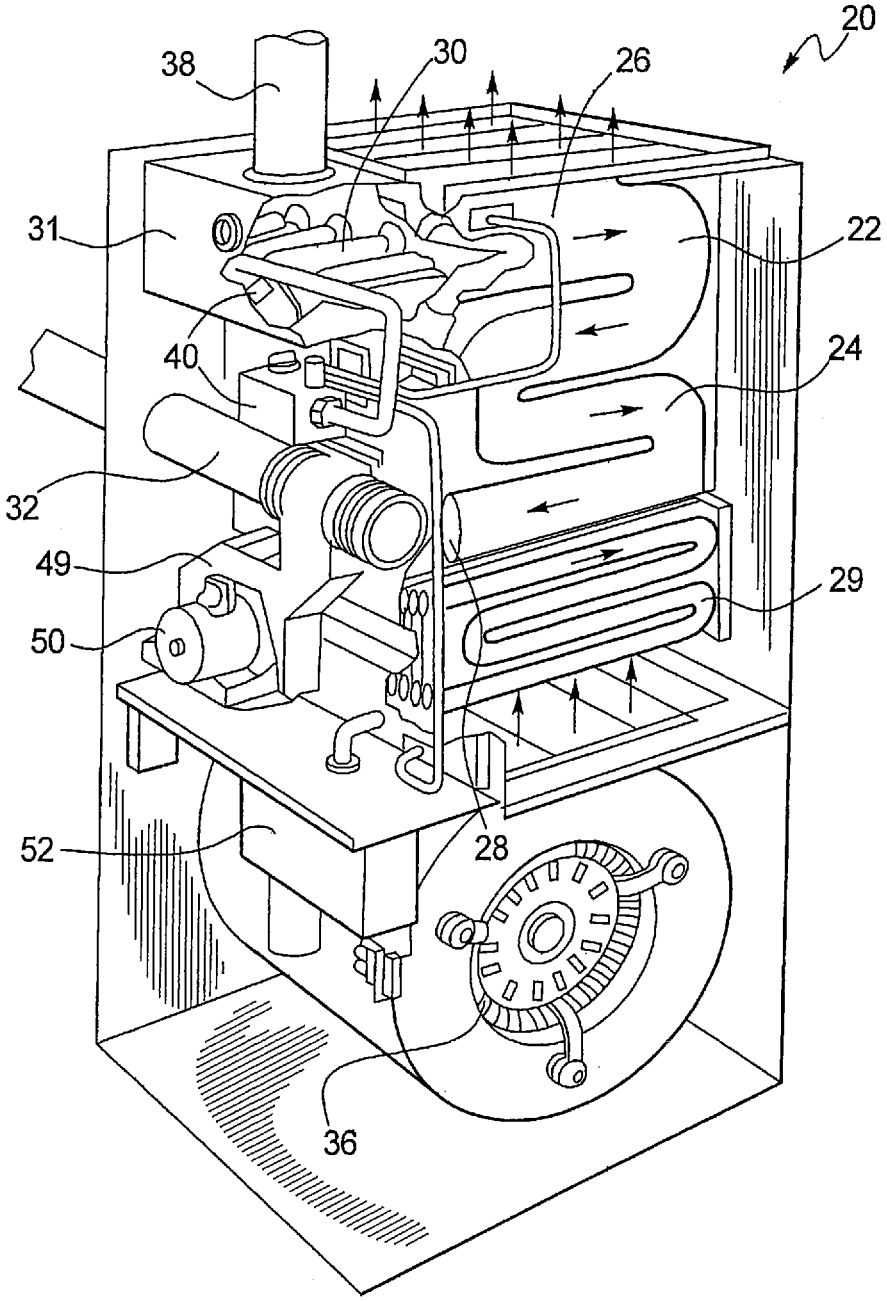
FIG. 1 is a schematic representation of a furnace constructed in accordance with the teachings of the present disclosure.

Referring now to the drawings, and with specific reference to FIG. 1, a furnace constructed in accordance with the teachings of the present disclosure is generally referred to by reference numeral 20. While described herein primarily in conjunction with a furnace, it is to be understood the burner disclosed can be used in additional settings as well, including but not limited to, boilers and other heat generation equipment.

The furnace 20 may include a heat exchanger 22 having a plurality of individual heat exchanger coils 24. The heat exchanger coils 24, which may be metallic conduits, are provided in a serpentine fashion to provide a large surface area in a small overall volume of space, the importance of which will be discussed in further detail below. Each heat exchanger coil 24 includes an inlet 26 and an outlet 28. A secondary or condensing heat exchanger 29 may be provided as well. A burner 30 is operatively associated with each inlet 26, and a vent 32 is operatively associated with each outlet 28. The plurality of burners 30 may collectively be provided in a burner box 31. The burners 30 introduce a flame and combustion gases 34 (see FIG. 3) into the heat exchanger coils 24, while the vent 32 releases the combustion gases 34 to the atmosphere after the heat of the flame and combustion gases 34 is extracted by the heat exchanger 22.

In order to extract that heat, a blower motor 36 may be provided to create significant air flow across the heat exchanger coils 24. As the air circulates across the heat exchanger coils 24 it is heated and can then be directed to a space to be heated such as a home or commercial building by way of appropriate ductwork (not shown). The furnace 20 may also provide combustion air inlet 38.

Figure 3:
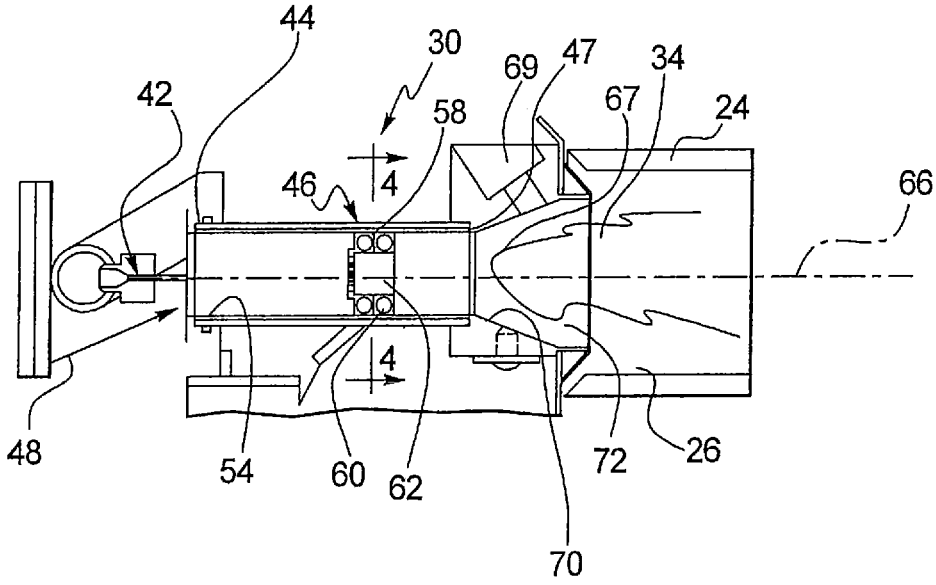
FIG. 3 is a sectional view of a burner and heat exchanger assembly constructed in accordance with the teachings of the present disclosure.

To generate the flame and hot combustion gases 34, the burners 30 mix fuel and air and ignite same. Referring now to FIG. 3, the fuel is typically natural gas or propane and is provided to a spray nozzle or jet 42 positioned at an inlet 44 to the burner 30. More specifically, the burner 30 may include a burner tube 46 having the inlet 44 and an outlet 47. All of the air necessary for combustion is also introduced into the burner 30 at inlet 44. Such air (represented by arrow 48 in FIG. 3) is introduced by inducing an air flow using a motorized fan 49 downstream of the burner outlet 46. More specifically, a motor 50 having the fan 49 coupled thereto is operatively associated with the outlet of 28 the heat exchanger coils 24 to induce a draft and pull the pre-mixture and flame 37 therethrough. When energized, the fan rotates and induces an air flow pulling air through the heat exchanger coils 24 and burners 30. Control of the motor 50, as well as the motor 36 may be controlled by a processor 52 such as an integrated furnace control (IFC). The motors 36 and 50 may be variable speed motors adapted to rotate at differing velocities as dictated by signals received from the IFC 52.

Figure 2:
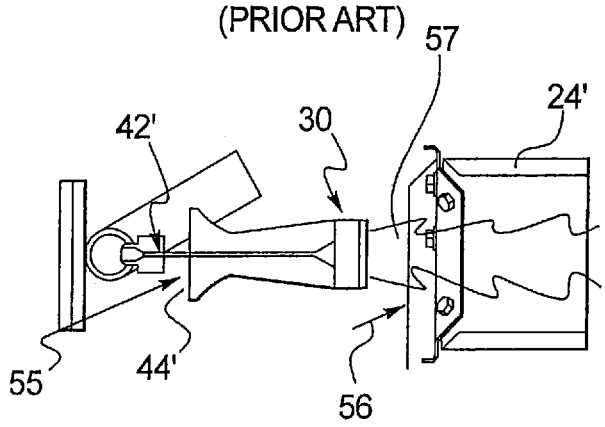
FIG. 2 (PRIOR ART)
FIG. 2 is a sectional view of a burner constructed in accordance with a prior art design utilizing an in-shot ignition system.

Comparing FIG. 3 to FIG. 2, the differences between the presently disclosed burner 30 of FIG. 3 and the prior art burner of FIG. 2 are shown in more detail. As indicated above, the burner 30 of the present disclosure may include the burner tube 46 having the inlet 44 and outlet 47, with the outlet 47 integrated into the heat exchanger inlet. As all of the air needed for combustion is provided by inlet 44, the inlet 44 also serves as and defines a mixing chamber 54 with the fuel. In order to reduce $NO_x$ emissions, the fuel and air must be premixed prior to ignition. No source of secondary air can be provided. This is a significant departure from the prior art "in-shot" burner depicted in FIG. 2, wherein primary air 55 enters through inlet 44' and secondary air 56 enters through gap 57 after initial ignition and thereby leads to the unacceptably high $NO_x$ emissions levels associated with the prior art.

Figure 4:
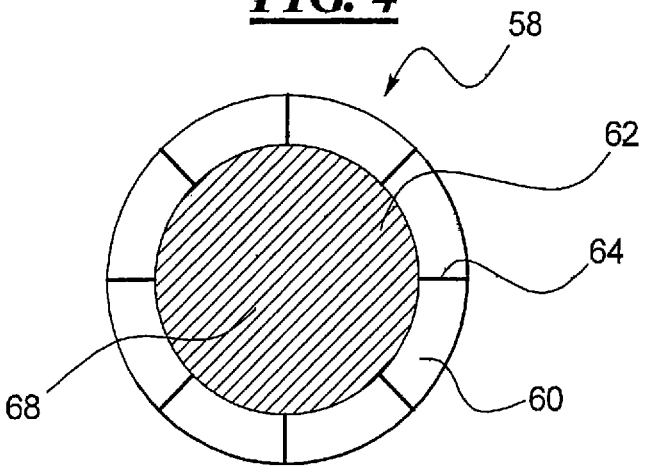
FIG. 4 is a sectional view of the burner of FIG. 3, taken along line 4-4 of FIG. 3.

In order to provide a stable flame 34 in such an induced draft furnace 20, the burner 30 may further includes a mechanical swirler 58. As shown both in FIG. 3 and FIG. 4, the swirler may include an annular plenum 60 surrounding a central passageway 62. The annular plenum 60 may include a plurality of vanes 64 provide at an angle relative to the longitudinal axis 66 of the burner 30. In so doing the premixed air and fuel flowing through the annular plenum 60 is deflected by the vanes 64. A tangential or rotational vector is therefore introduced to the flow of the mixed air and fuel. In combination with the mixed air and fuel flowing through the central passageway 60 this creates an exiting plume 67 of fuel and air that can be controlled and results in a stable flame 34. The central passageway 62 may be provided with a flow restrictor 68 to create a pressure drop from the inlet 44 to the outlet 46. The amount of restriction lets the flow split between the central and annular flow paths. The flow restrictor 68 can be provided in the form of a wire mesh, screen or filter, or the aforementioned venturi, with the level of restriction being selected to result in the flame characteristics desired. Two examples of such low swirl burners are set forth in U.S. Pat. Nos. 5,879,148 and 5,735,681, both assigned to Lawrence Berkeley National Laboratories and both herein incorporated in their entireties by reference.

Figure 5:
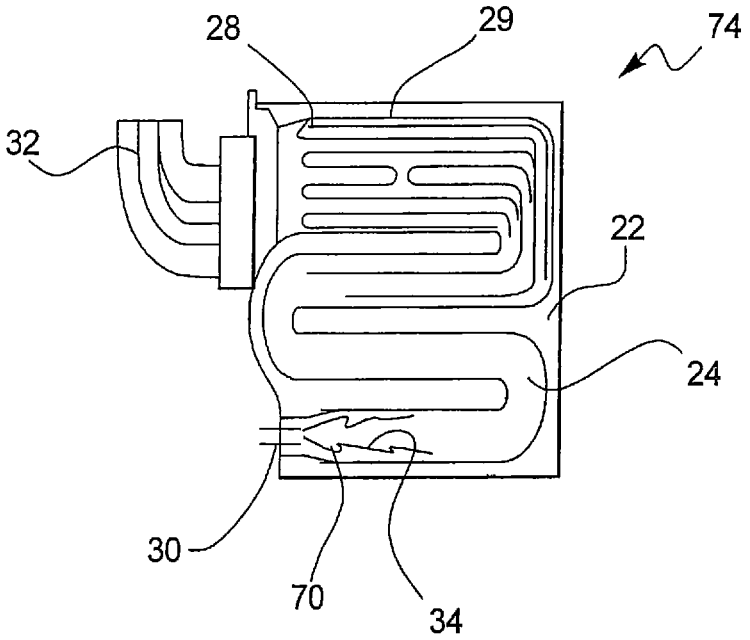
FIG. 5 is a sectional view the burner and heat exchanger assembly constructed in accordance with the teachings of the present disclosure.

Upon exit from the swirler 58, the plume 67 of mixed air and fuel encounters an igniter 69. With ignition, the flame and combustion gases are created and directed into the heat exchanger coils 24 as indicated above. To supplement the stability of the flame 34, the burner 30 may be provided directly within the inlet 26 of the heat exchanger coils 24 as shown best in FIG. 5. In so doing, the flame 34 is held within the heat exchanger 22 in its entirety. Moving the flame 34 into the heat exchanger 24 where air is present enables the heat to be more efficiently extracted, while at the same time making a more compact assembly and enabling the heat exchanger inlet and burner outlet to be integrated and sealed against the introduction of any secondary air. In addition, the inlets 26 of the heat exchanger coils 24 may be fabricated, as by stamping, so as to have reception surfaces 70 which form a frusto-conically shaped flame expansion zone 72. Provision of the frusto-conically shaped flame expansion zone 72 encourages creation and maintenance of the flame 34, while at the same time facilitating manufacturability. Moreover, as will be noted from FIG. 5, the diameter of the heat exchanger coil 24 is significantly greater than the diameter of the burner tube 30 (roughly double in one embodiment) to confine and yet maintain the proper flowfield for flame 34 stabilization.

In operation, it can therefore be seen that the present invention provides a furnace 20, a burner and heat exchanger assembly 74, and a method of operation same that works with an induced draft air flow and provides reduced $NO_x$ emissions. The method of operation may include the steps of providing a furnace 20 or burner and heat exchanger assembly 74 as indicated above, inducing air flow through the burner 30 and heat exchanger 22 using a downstream motor 50, introducing fuel flow through the fuel nozzle 42, and energizing the igniter 69. In so doing, a swirling, and conically expanding, flame 34 is created using a single air source and thus with reduced $NO_x$ emissions. In addition, by providing the burner 30 directly within the heat exchanger inlet 26, and providing the inlet 26 in the form of a frusto-conically shaped expansion zone 72, the resulting flame 34 is both reduced in terms of $NO_x$, and stable.

Industrial Applicability

From the foregoing, it can be seen that the technology disclosed herein has industrial applicability in a variety of settings such as, but not limited to, residential and commercial furnaces. Using an induced draft approach sufficient air needed for combustion can be pulled through the burner and heat exchanger without needing a secondary air source. Eliminating any secondary air source also reduces $NO_x$ emissions. In addition, using a mechanical swirler, the flame produced by the burner, even though used in an induced draft system is stable and sustainable. This stability and sustainability are supplemented by positioning the burner within the heat exchanger inlet, and shaping the heat exchanger inlet to have a frusto-conical shape so as to support the stability of the flame. Such a burner or burner and heat exchanger assembly can also be used in other heating equipment such as boilers, among others.

It is to be understood that the teachings of the present disclosure can be practiced by the foregoing embodiments as well as other embodiments not specifically disclosed but encompassed by the literal and equivalent scope afforded by the appended claims.

What is claimed is:

1. An induced draft furnace, comprising:

a heat exchanger having a heat exchanger coil, the heat exchanger coil providing a conduit for combustion gases and having an inlet and an outlet, the outlet being connected to a vent;

an inducer motor operatively associated with the heat exchanger outlet to draw air through the heat exchanger;

a burner tube adapted to direct a flame into the heat exchanger coil inlet, the burner tube having an inlet and an outlet, the burner tube outlet being positioned within the heat exchanger coil inlet in a sealed fashion so as to prevent introduction of secondary air into the heat exchanger coil inlet;

a swirler provided with the burner tube between the inlet and the outlet;

a source of fuel connected to the burner tube inlet;

a source of air operatively associated with the burner tube inlet; and a blower motor adapted to direct air flow across the heat exchanger to extract heat from the heat exchanger.

2. The furnace of claim 1, wherein the burner tube outlet is integrated into the heat exchanger coil inlet.

3. The furnace of claim 2, wherein the heat exchanger coil inlet includes reception surfaces forming a frusto-conically shaped expansion zone for the flame.

4. The furnace of claim 2, wherein the heat exchanger coil inlet and burner tube outlet are sealed together.

5. The furnace of claim 1, wherein the burner tube inlet includes a mixing chamber, the air and fuel pre-mixing in the mixing chamber prior to reaching the swirler.

6. The furnace of claim 5, wherein the swirler includes an annular plenum surrounding a central passageway, the annular plenum including a plurality of vanes to introduce a tangential vector to the air and fuel mixture exiting the swirler.

7. The furnace of claim 6, wherein the central passageway creates a pressure drop between the burner tube inlet and the burner tube outlet.

8. A heat exchanger assembly, comprising:

a heat exchanger coil providing a conduit for combustion gases and having an inlet and outlet, the inlet including reception surfaces forming a frusto-conically shaped flame expansion zone;

an inducer motor operatively associated with the heat exchanger coil outlet; and a burner tube positioned within the heat exchanger coil inlet, the burner tube including an inlet and an outlet with a swirler between the inlet and outlet.

9. The heat exchanger assembly of claim 8, further including a plurality of heat exchanger coils, each having an inlet and an outlet with the inlet including reception surfaces forming a frusto-conically shaped flame expansion zone, a burner tube positioned with the inlet, and the inducer motor operatively associated with each outlet.

10. The heat exchanger assembly of claim 8, wherein burner tube is positioned within the heat exchanger coil inlet such that a flame produced by the burner tube is received within the expansion zone in its entirety.

11. The heat exchanger assembly of claim 8, wherein burner tube inlet defines a mixing chamber for fuel and air prior to reaching the swirler.

12. The heat exchanger assembly of claim 11, wherein the swirler includes an annular plenum surrounding a central passageway.

13. The heat exchanger assembly of claim 12, wherein the annular plenum includes a plurality of vanes introducing a tangential vector to the mixed air and fuel exiting the swirler.

14. The heat exchanger assembly of claim 13, wherein the central passageway creates a pressure drop between the burner tube inlet and the burner tube outlet.

15. A method of operating an induced draft furnace, comprising:

providing a heat exchanger coil that provides a conduit for combustion gases, the heat exchanger coil having an inlet and an outlet;

connecting a motorized fan provided at and connected to the heat exchanger outlet and thereby inducing an air flow through the heat exchanger;

positioning a burner in the heat exchanger coil inlet in a sealed fashion so as to prevent introduction of secondary air into the heat exchanger coil inlet, the burner including an inlet, an outlet, and a swirler between the inlet and the outlet;

pre-mixing air and fuel in the inlet of the burner;

inducing flow of the mixed air and fuel through the burner with the motorized fan;

introducing a swirling flow pattern to the mixed air and fuel by passing the mixed air and fuel through the swirler;

igniting the mixed air and fuel into a flame; and directing the flame into the heat exchanger coil inlet.

16. The method of operating an induced draft furnace of claim 15, further comprising containing the flame entirely with the heat exchanger coil inlet.

17. The method of operating an induced draft furnace of claim 16, further comprising providing the heat exchanger coil inlet with reception surfaces defining a frusto-conically shaped inlet.

18. The method of operating an induced draft furnace of claim 15, wherein the swirl is introduced by providing the swirler with an annular plenum surrounding an central passageway, with the annular plenum including a plurality of angularly disposed vanes.

19. The method of operating an induced draft furnace of claim 18, wherein the central passageway creates a pressure drop between the burner inlet and burner outlet.

20. The method of operating an induced draft furnace of claim 19, wherein the central passageway creates the pressure drop by restricting air flow through the central passageway.

* * * * *